US005579927A

United States Patent [19]

Thompson et al.

[11] Patent Number: 5,579,927

[45] Date of Patent: Dec. 3, 1996

[54] PEG RACKING DEVICE

[75] Inventors: Jennings I. Thompson; M. H. Johnson, both of Bloomington, Minn.

[73] Assignee: Dip Co., Bloomington, Minn.

[21] Appl. No.: 277,876

[22] Filed: Jul. 20, 1994

[51] Int. Cl.[6] ..... A47F 1/04

[52] U.S. Cl. ..... 211/59.1; 211/57.1

[58] Field of Search ..... 211/59.1, 57.1, 211/106; 248/220.3, 220.4, 221.1, 221.2, 222.2

[56] References Cited

U.S. PATENT DOCUMENTS

| | | | |
|---|---|---|---|
| 3,211,293 | 10/1965 | Tarnoff | 211/59 |
| 3,442,396 | 5/1969 | Cass | 248/220.3 |
| 3,638,801 | 2/1972 | Larson | 211/57 |
| 3,897,926 | 8/1975 | Silver | 248/221.1 |
| 4,066,169 | 1/1978 | Hochman | 211/57.1 |
| 4,362,249 | 12/1982 | Thalenfeld | 211/59.1 |
| 4,610,413 | 9/1986 | Pedersen | 248/220.3 |
| 4,823,964 | 4/1989 | Lundberg | 211/57.1 |
| 5,054,727 | 10/1991 | Campbell et al. | 248/220.3 |
| 5,348,167 | 9/1994 | Jensen | 211/57.1 |

FOREIGN PATENT DOCUMENTS

| | | | |
|---|---|---|---|
| 477305 | 8/1963 | United Kingdom | 248/220.4 |

*Primary Examiner*—Ramon O. Ramirez
*Assistant Examiner*—Willie Berry, Jr.
*Attorney, Agent, or Firm*—Gregory P. Kaihoi

[57] ABSTRACT

A peg racking device which facilitates loading of new inventory on the back of the peg without removing the existing inventory from the front of the peg so that the inventory is sold on a FIFO basis. An elongated shaft, the rear end of which is attachable to a wall. The device includes an elongated shaft, the rear end of which is attachable to a wall, and a removable sleeve which is axially moveable along the shaft. A locking mechanism is provided having first and second elements, the first element being carried by the shaft and the second element being carried by the sleeve. The first and second elements engage one another in the locked position to prevent relative axial movement of the sleeve with respect to the shaft. The device may include a handle having a cavity formed to receive the front end of the sleeve to assist in removing the sleeve from the shaft and replacing the sleeve on the shaft, reducing the risk of dropping the sleeve and/or inventory on the sleeve during the restocking process.

10 Claims, 3 Drawing Sheets

PEG RACKING DEVICE

FIELD OF THE INVENTION

The present invention relates to pegs used in peg racks for displaying merchandise in packages.

BACKGROUND OF THE INVENTION

Products in blister packaging or other packaging often are displayed on racks having a number of horizontally projecting pegs in various types of retail outlets such as department stores, sporting goods stores, automotive supply stores, hardware stores, drugstores and grocery stores. Each peg carries an individual type of product by placing the peg through a hole in the packaging. Usually the pegs are spaced as closely as possible to maximize the utilization of valuable retail space. Certain types of perishable stock such as meats, cheeses and vegetables must be rotated and sold on a first-in-first-out (FIFO) basis to reduce the amount of stock that perishes before it is sold.

One method of rotating stock is to remove the existing inventory from a peg, load the new inventory on the back of the peg, and then re-load the existing inventory on the peg. This method is costly not only because it is labor intensive, but also because it is tedious work and many stock persons simply load the new inventory on the front of the peg. Accordingly, the existing inventory often perishes on the back of the peg. It would be desirable, therefore, to provide a peg in which the inventory may be rotated without removing existing inventory, and which may be spaced as closely as possibly to other pegs.

U.S. Pat. No. 4,610,413 discloses a device for displaying packages having a peg support with a front hole and a back hole, the peg support being attached to a wall or the like; the peg has a body, a rear toe and a bottom flat engageable with the keyhole. The peg is attached to the peg support by reaching from the front of the pegs to the peg support attached to wall behind all of the products, and then threading the rear toe of the peg through the front hole and into the back hole. The peg is removed from the peg support by lifting the front of the peg and pulling the rear toe out of the back hole. New inventory may be placed on the back of the peg without having to remove the existing inventory by removing the peg from the peg support, loading the new inventory on the back of the peg, and then attaching the peg to the peg support. This system can be difficult to utilize, however, when the product packages are spaced closely together, particularly if there are many packages on a single peg-stock personnel can have a difficult time threading the rear toe into the rear hole, since adjacent packages tend to obstruct one's view. Also, the system requires vertically adjacent packages to be spaced from one another a sufficient distance so as to allow the front end of the peg to be lifted enough to disengage it from the rear hole.

U.S. Pat. No. 5,054,727 discloses a device for shipping, storing and racking packages that hang on pegs on display racks. The device includes a number of packages on a storage/transfer member within a container. An opening is provided along the longitudinal axis of the storage/transfer member to permit the member to be slid over a display rack peg. A group of packages are deposited on a peg by sliding the storage/transfer member over the peg, then holding the packages on the peg as the member is slid off of the peg. Conversely, a group of packages is removed from the peg by sliding the storage/transfer member over the peg and through the holes in the packages, raising a box or magazine up to the packages to support the packages and storage/transfer member, and then sliding the storage/transfer member off of the peg. The peg and storage/transfer member do not lock together, so the storage/transfer member typically has to be removed after it is installed to prevent the storage/transfer member from sliding off of the peg as consumers remove individual packages from the peg. The system is thus somewhat cumbersome to use.

U.S. Pat. No. 3,211,293 discloses a rack mounting device in which a number of packages may be loaded onto a peg in a single operation. The device includes a tube extending through the holes of a stack of products, and a rubber band for holding the stack onto the tube. The stack of products is loaded onto a peg by placing the tube over the front of the peg, releasing the rubber band, and then sliding the packages over the tube and onto the peg.

These and other proposed systems are typically cumbersome to utilize particularly when packages are closely spaced, and particularly if many heavy packages are held on a single peg. Thus, there is a need for a peg racking system that provides a convenient, easy-to-operate device in which new inventory may be added to a peg behind the existing inventory so that the inventory is sold on a FIFO basis.

SUMMARY OF THE INVENTION

The peg racking system of the present invention utilizes a peg having an elongated shaft with a longitudinal axis and front and rear ends. The rear end of the shaft is attachable either directly to a wall (e.g., a panel of pegboard) or to a bracket which in turn is attachable to a wall. A removable sleeve having front and rear ends is provided, the sleeve being axially and rotationally moveable with respect to at least part of the shaft, between a locked position and a removed position. The peg includes a locking mechanism having first and second mating elements, wherein the first element is carried on (or formed integrally in) the shaft and the second element is carried by (or formed integrally in) the sleeve. The first and second elements engage one another in a locked position to prevent axial movement of the shaft with respect to the sleeve.

In operation, new inventory is added to the back of the peg by first disengaging the locking mechanism and sliding the sleeve off of the shaft, carrying the existing inventory along with the sleeve. New inventory can then be placed on the back of the sleeve behind the existing inventory, and the sleeve can then be slid back over the shaft and the locking mechanism can be engaged to prevent the sleeve from sliding off the peg.

The present invention thus provides a peg racking system in which new inventory may be loaded easily on the back of the peg without removing the existing inventory from the front of the peg so that the inventory is sold on a FIFO basis. The system provides easy removal and re-loading of existing inventory without requiring vertical displacement of the peg, and the insertion point is located toward the front of the pegs so that stock personnel can easily align the two elements with respect to one another. The device further provides a handle for facilitating manipulation of the sleeve and the packages after the sleeve is removed from the shaft so that the packages do not fall off of the sleeve.

DETAILED DESCRIPTION OF A PREFERRED EMBODIMENT

Figure 1:
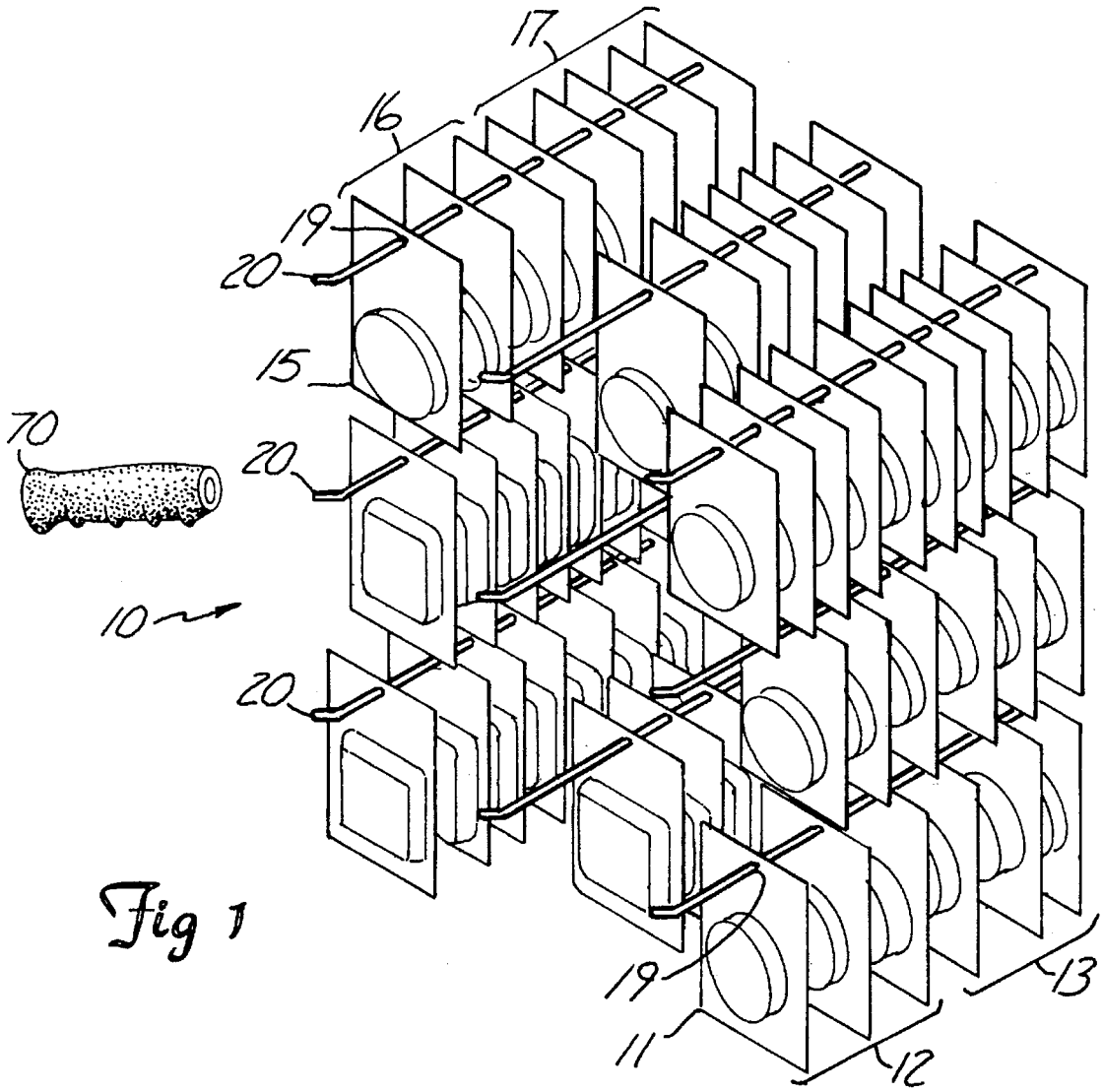
FIG. 1 is a perspective view of a peg racking system of the invention.

FIG. 1 depicts peg racking system 10 having a number of pegs 20 attached to a wall (not shown, though it may be any conventional type of pegboard or series of peg racking brackets). The pegs 20 project from the wall, and each peg 20 generally holds an individual type of packaged product 11, 15, by placing the peg 20 through a hole 19 in the package.

Figure 2:
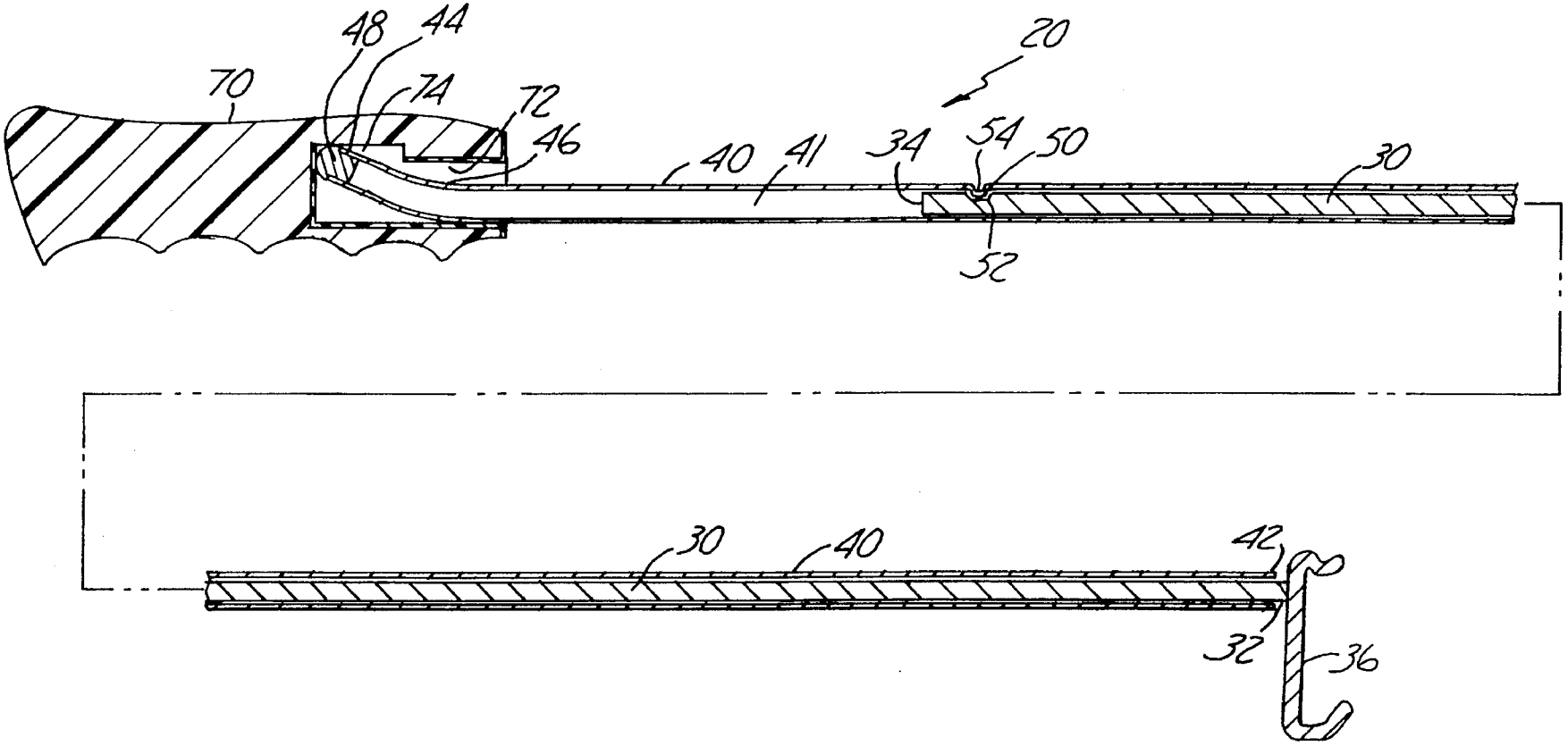
FIG. 2 is a cross-sectional view of a peg in accordance with the invention.

FIG. 2 shows a preferred embodiment of a peg 20, in which the peg 20 includes an elongated shaft 30 having rear and front ends 32, 34, respectively, and a removable sleeve 40. In a preferred embodiment, the transverse cross-section of the shaft is circular, though any other suitable shape may also be used. The rear end 32 of the elongated shaft 30 is attached to either a wall (not shown) or a bracket 36, the bracket 36 being attachable to a wall (typically by engaging a complementary bracket mounted to the wall). Preferably, the rear end 32 is attached to the bracket 36 so that the shaft 30 may be removed from, or repositioned on, the wall. The bracket 36 may be C-shaped as shown, L-shaped, V-shaped or any other suitable shape that fixedly attaches the shaft 30 to the wall or complementary bracket. Also, the bracket 36 may be a separate piece as shown or it may be formed integrally with the shaft 30. The configuration of the bracket will depend upon the parameters defined by the mounting surface to which the shaft 30 is to be attached. It will be appreciated that the peg 20 of the present invention can be adapted to work in conjunction with almost any type of pegboard or wall by designing the bracket 36 to attach the shaft 30 to the particular pegboard or wall.

The removable sleeve 40 has rear and front ends 42, 44, respectively, and an elongated cavity 41 for receiving the shaft 30. The sleeve 40 is axially and rotationally moveable with respect to the shaft 30 so that the sleeve 40 may inserted over, or removed from, the shaft 30. The sleeve 40 may be removed from the shaft 30 by sliding the sleeve along the shaft until the rear end 42 of the sleeve moves past the front end 34 of the shaft. In a preferred embodiment, the front end 44 of the sleeve has an angled tip 46 to prevent packages from freely sliding off of the sleeve, and a plug 48 to close the cavity 41 at the front end 44 of the sleeve.

The peg 20 also includes a locking mechanism 50 having a first locking element 52 formed in the shaft 30 and a second complementary locking element 54 formed in the sleeve 40 (these elements of the locking mechanism are depicted as being formed in the respective components of the peg, but could also be separately manufactured and secured to the components of the peg). The first and second locking elements 52, 54, respectively, engage one another to prevent relative axial movement of the shaft 30 with respect to the sleeve 40. In a preferred embodiment, the first and second locking elements 52, 54 are positioned on the shaft 30 and sleeve 40, respectively, so that shaft 30 and the sleeve 40 are in a locked position when the rear end 42 of the sleeve is positioned substantially towards the rear end 32 of the shaft. By so positioning the sleeve 40 over substantially the full length of the shaft 30 in a locked position, the shaft 30 supports most (and preferably all) of the weight of the packages (not shown).

Figure 3:
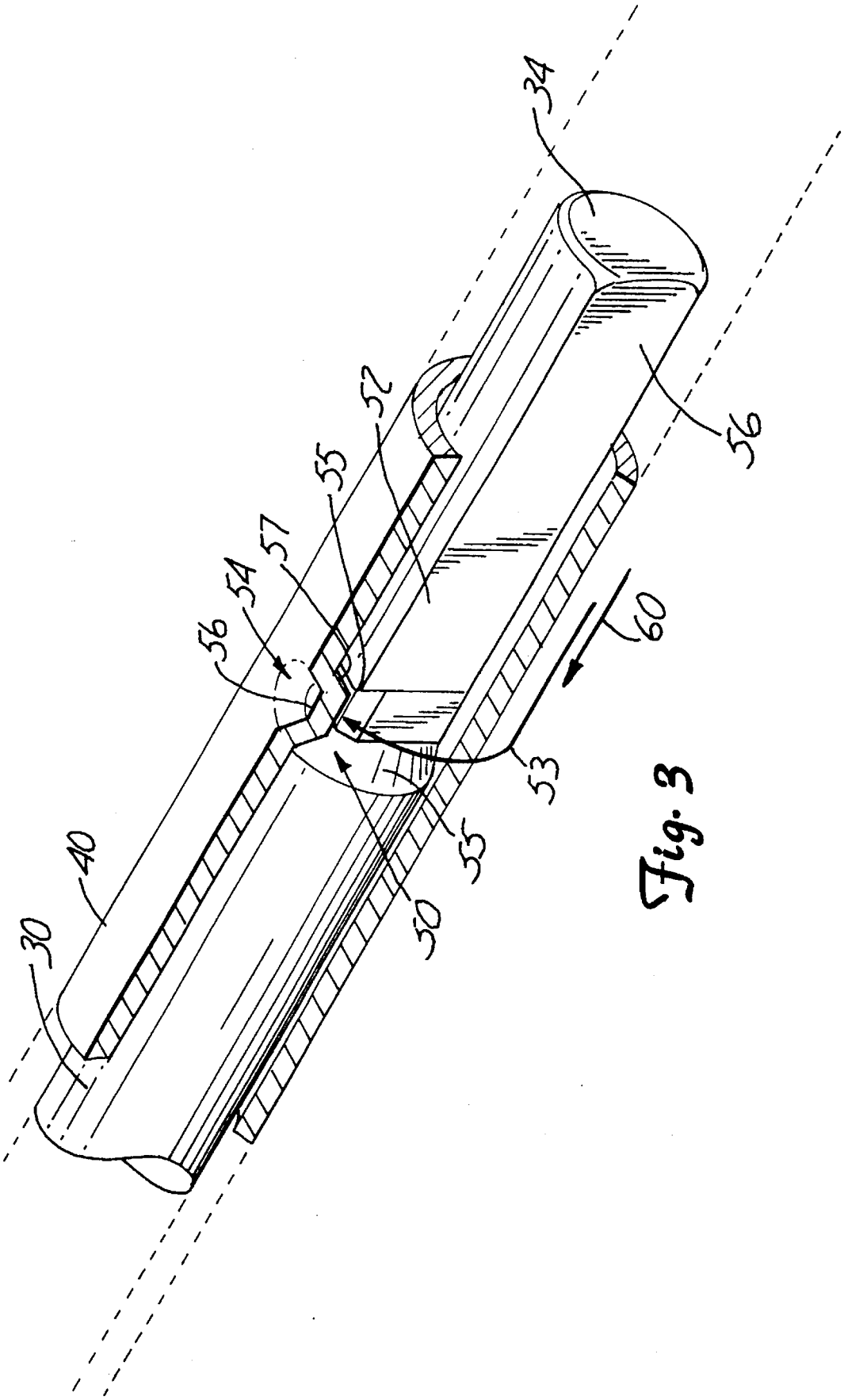
FIG. 3 is a cross-sectional view of a locking mechanism in accordance with the invention.

FIG. 3 depicts a preferred embodiment of the locking mechanism 50 with the first and second locking elements 52, 54 being engaged in the locked position. In this embodiment, the first locking element 52 includes a channel 55 and a recess 56 located near the front end 34 of the shaft 30. The channel 55 extends transversely around the shaft from the recess 56 to the top of the shaft 57. The recess 56 is a vertical face formed along the side of the shaft 30, extending from the channel 55 to the front end 34 of the shaft. The second locking element 54 is a complementary detent 58. To engage the first and second elements of the locking mechanism 50, the sleeve 40 is slid over the shaft 30 towards the wall with the detent 58 being initially aligned with the vertical face of the recess 56. As the sleeve 40 is slid along the shaft 30, the detent 58 moves along the recess in the direction of arrow 60 until it meets the channel 55, and then the sleeve 40 is rotated in the direction of arrow 53 so that the detent 58 moves along the channel 55 until it reaches the end of the channel. In a preferred embodiment, the end of the channel 55 is positioned so that the angled tip 46 of the sleeve 40 is oriented vertically upwardly with respect to the sleeve when the detent 58 cannot rotate any further. (The absolute angular orientations of the detent, channel and recess are not as important as their relative orientation with respect to one another.) The locking mechanism is disengaged by reversing the process described above.

Alternately, the first locking element could be a detent located near the rear end 32 of the shaft, and the second locking element could be an L-shaped groove with the body of the "L" longitudinally extending from the rear end 42 of the sleeve and the foot of the "L" extending transversely along the sleeve. In such an embodiment, the locking mechanism is engaged by aligning the body of the L-shaped groove with the detent on the shaft, axially sliding the sleeve 40 over the shaft 30 until the detent reaches the foot of the L-shaped groove, and then rotating the sleeve with respect to the shaft so that the detent travels in the foot of the L-shaped groove.

In yet another alternative embodiment, the first or second locking elements could be a spring biased pin, and the other element may be a pin receiving aperture. In such an embodiment, the sleeve may be slid over the shaft be depressing the pin; the shaft and sleeve may then be locked together by positioning the sleeve and shaft so that the pin is urged into the aperture under the force of the spring.

Referring to FIGS. 1 and 2, a preferred embodiment of the peg racking system 10 includes a handle 70 for enhancing the user's ability to grip the sleeve 40. In a preferred embodiment, the handle 70 has a generally oval-shaped opening 72 and an internally enlarged cavity 74. The major axis of the oval opening 72 is slightly less than the height of the angled tip 46 and the interior cavity has a height slightly greater than the angled tip 46. The handle 70 engages the angled tip 46 by allowing the uppermost portion of the angled tip 46 to extend into the enlarged interior cavity 74. The handle may enhances the user's ability to axially and rotationally grip and position the sleeve over the shaft. This is particularly valuable if the merchandise is relatively heavy, as, e.g., in the case of luncheon meats. The shape of the handle 70 and the sleeve receiving opening are defined by the shape of the sleeve 40.

It will be appreciated that the present invention is not limited to handles having an oval opening 72 and a cavity 74, but other shapes including circular, square, rectangular or any other suitable shape may be used, so long as they perform the function of assisting in manipulating the sleeve. In one preferred embodiment the opening is generally round and is provided with an O-ring (or similar resilient means), secured either to the end of the handle around the opening 72 or secured just inside the opening, for resiliently engaging the sleeve 40. Preferably the O-ring (or similar resilient means) has an internal diameter just slightly smaller than outer diameter of the sleeve 40 to create a snug fit, inhibiting unwanted relative movement of the sleeve with respect to the handle while permitting relatively easy insertion and withdrawal of the sleeve into and out of the handle during use.

The handle may be made from any suitable material that is durable and cost effective. Preferably, the handle is made from a relatively hard plastic, but it may be any other suitable material such as metal or wood. Alternately the handle may be made from a relatively flexible plastic such that the handle may be squeezed to functionally engage the sleeve so that the sleeve may be axially and rotationally positioned along the shaft.

Referring to FIGS. 1—3, the pegs 20 may be arranged in a peg racking system 10 to carry an inventory of many different products. FIG. 1 shows the lower right peg 20 holding a product 11, and the upper left peg holding a product 15. The present invention is especially useful for displaying perishable comestibles such as meats and cheeses, which can be relatively heavy. For example, product 11 may be a meat and product 15 may be a cheese being displayed in a refrigerator case of a grocery store. To simplify the description of the present invention, only the inventory management of the new and existing inventories 12, 13, respectively, of product 11 will be described. It will be appreciated that the peg system of the present invention will operate substantially the same regardless of the type of inventory carried by the pegs 20.

In use, existing inventory 12 illustrated in the drawings is disposed on the sleeve 40 and the shaft 30 and the sleeve 40 are in the locked position. New inventory 13 is added to the back of the peg by disengaging the locking mechanism 50 and sliding the sleeve 40, and the existing inventory 12 that is carried by the sleeve, off of the shaft 30. The new inventory 13 is then placed over the rear end 42 of the sleeve 40 so that the existing inventory 12 is at the front end 44. The rear end 42 of the sleeve 40 is then inserted over the front end 34 of the shaft 30, and the sleeve 40 is moved axially along the shaft until the first and second locking elements engage one another to lock the sleeve and shaft together. In a preferred embodiment, the handle 70 may be used to positively grip the sleeve 40, which reduces the risk of dropping the sleeve after it is removed from the shaft while enhancing the user's ability to rotate and axially move the sleeve relative to the shaft.

The present invention offers several advantages, the first of which is that inventory may be easily rotated so that it can be sold on a FIFO basis. Another advantage is that the pegs may be placed very closely together because they may be removed without any vertical movement of the front end of the peg. Yet another advantage is that the sleeves can be inserted over the pegs out in front of the packages instead of behind the packages where it is difficult to thread the back end of the peg into a series of holes. Moreover, the sleeve may be easily manipulated because the handle affords the user a better grip.

While a preferred embodiment of the present invention has been described, it should be understood that various changes, adaptations and modifications may be made therein without departing from the spirit of the invention and the scope of the appended claims.

What is claimed is:

1. A peg racking device, comprising:

an elongated shaft having a longitudinal axis and front and rear ends, the rear end being attachable to a wall;

a removable sleeve having a longitudinal axis and front and rear ends, the sleeve being axially moveable along and rotationally moveable about at least part of the shaft between a locked position and a removed position;

a locking mechanism having first and second elements, the first element being carried by the shaft and the second element being carried by the sleeve, the first and second elements engaging one another in the locked position to prevent relative axial movement of the sleeve with respect to the shaft; and a handle having a cavity therein being formed to receive the front end of the sleeve, whereby the handle may be used to assist in removing the sleeve from the shaft and replacing the sleeve on the shaft.

2. The racking device of claim 1, wherein the cavity in the handle has an oval opening, the front end of the sleeve being receivable through the opening and into the cavity.

3. The racking device of claim 1, further comprising a bracket connected to the rear end of the shaft for removably attaching the shaft to the wall.

4. The racking device of claim 1, wherein the shaft and the sleeve have generally circular cross-sections.

5. The racking device of claim 1, wherein the front end of the sleeve extends upwardly at an obtuse angle to the sleeve when the sleeve and shaft are in the locked position.

6. The racking device of claim 5, wherein:

the first element is integral with the shaft and further comprises a channel and a recess, the channel being positioned between the front and rear ends of the shaft and extending generally transversely at least partly around the shaft and the recess extending generally axially along the shaft at least from the channel to the front end of the shaft; and the second element is integral with the sleeve and further comprises a detent, the first and second elements being engaged in the locked position when the detent is axially moved along the recess then rotationally moved into the channel.

7. The racking device of claim 6 wherein the shaft and sleeve each have a circular cross-section, the channel being positioned along the upper portion of the shaft and the recess being a generally vertical face.

8. The racking device of claim 1 if wherein the front end of the sleeve is closed.

9. The racking device of claim 1 wherein:

the first element of the locking mechanism is integral with the shaft and further comprises a channel and a recess, the channel being positioned between the front and rear ends of the shaft and extending generally transversely at least partly around the shaft, and the recess extending generally axially along the shaft at least from the channel to the front end of the shaft; and the second element of the locking mechanism is integral with the sleeve and further comprises a detent, the first and second elements being engaged in the locked position when the detent is axially moved along the recess then rotated into the channel.

10. The racking device of claim 9, wherein the shaft and sleeve each have a circular cross-section, the channel being positioned along the upper portion of the shaft and the recess being a generally vertical face.

* * * * *